US010309140B2

(12) United States Patent
Imaoka

(10) Patent No.: US 10,309,140 B2
(45) Date of Patent: Jun. 4, 2019

(54) GUIDE RAIL FITTING STRUCTURE AND WINDOW REGULATOR

(71) Applicant: HI-LEX CORPORATION, Takarazuka-shi (JP)

(72) Inventor: Takayuki Imaoka, Takarazuka (JP)

(73) Assignee: HI-LEX CORPORATION, Takarazuka-shi (JP)

( * ) Notice: Subject to any disclaimer, the term of this patent is extended or adjusted under 35 U.S.C. 154(b) by 0 days.

(21) Appl. No.: 15/522,957

(22) PCT Filed: Oct. 28, 2015

(86) PCT No.: PCT/JP2015/080384
§ 371 (c)(1),
(2) Date: Apr. 28, 2017

(87) PCT Pub. No.: WO2016/068190
PCT Pub. Date: May 6, 2016

(65) Prior Publication Data

US 2017/0314307 A1 Nov. 2, 2017

(30) Foreign Application Priority Data

Oct. 31, 2014 (JP) ..... 2014-222267

(51) Int. Cl.
*E05F 11/48* (2006.01)
*E05D 15/16* (2006.01)
*E05F 15/689* (2015.01)

(52) U.S. Cl.
CPC ..... *E05D 15/165* (2013.01); *E05F 11/48* (2013.01); *E05F 11/483* (2013.01); *E05F 15/689* (2015.01);
(Continued)

(58) Field of Classification Search
CPC ... E05D 15/165; E05F 15/689; E05Y 2900/55
(Continued)

(56) References Cited

U.S. PATENT DOCUMENTS 5,657,580 A * 8/1997 Kobrehel ..... E05F 11/485 49/352
6,227,993 B1 * 5/2001 Medebach ..... E05F 11/382 474/144
(Continued)

FOREIGN PATENT DOCUMENTS

JP 05280245 A * 10/1993
JP 2004-150060 A1 5/2004
(Continued)

OTHER PUBLICATIONS

International Search Report for International Application No. PCT/JP2015/080384 dated Jan. 12, 2016.

*Primary Examiner* — Jerry E Redman
(74) *Attorney, Agent, or Firm* — Kratz, Quintos & Hanson, LLP

(57) ABSTRACT

A guide rail fitting structure includes a guide rail, a fitting body, and an insert inserted into the fitting body. The guide rail is fitted into the fitting body. The fitting body includes a fitting section fitted onto an end of the guide rail, and an insertion hole into which the insert is inserted from outside the fitting body. The fitting section is fitted onto the guide rail such that the insert is at least partially covered with the guide rail, the insert gets into a detachment inhibitive state, and the insert in the detachment inhibitive state is visible through an opening on an outer surface of the fitting body. This configuration allows easy assembly.

4 Claims, 4 Drawing Sheets

(52) U.S. Cl.
CPC ..... *E05Y 2201/654* (2013.01); *E05Y 2201/66* (2013.01); *E05Y 2900/55* (2013.01)

(58) Field of Classification Search
USPC ..... 49/348, 349, 352
See application file for complete search history.

(56) References Cited

U.S. PATENT DOCUMENTS

| | | | | |
|---|---|---|---|---|
| 7,596,908 | B2 * | 10/2009 | Rothe | E05F 11/385 49/349 |
| 7,882,658 | B2 * | 2/2011 | Staser | B60J 5/0416 49/352 |
| 8,402,694 | B2 * | 3/2013 | Daumal Castellon | E05F 11/481 49/348 |
| 9,151,102 | B2 * | 10/2015 | Debus | E05F 11/483 |
| 9,476,496 | B2 * | 10/2016 | Fukumoto | E05F 11/483 |
| 9,580,953 | B1 * | 2/2017 | Matsushita | E05F 15/689 |
| 2002/0139051 | A1 * | 10/2002 | Arquevaux | E05F 11/485 49/352 |
| 2003/0140562 | A1 * | 7/2003 | Staser | E05F 11/382 49/352 |
| 2006/0179720 | A1 * | 8/2006 | Vantrease | E05B 85/10 49/352 |
| 2007/0017159 | A1 * | 1/2007 | Moore | E05F 11/382 49/502 |
| 2007/0199246 | A1 * | 8/2007 | Renke | E05F 11/488 49/352 |
| 2007/0214726 | A1 * | 9/2007 | Graf | E05F 11/382 49/352 |
| 2007/0289218 | A1 * | 12/2007 | Castellon | E05F 11/483 49/352 |
| 2010/0154310 | A1 * | 6/2010 | Robalo | E05F 11/485 49/352 |
| 2011/0010999 | A1 * | 1/2011 | Broadhead | B60J 5/0416 49/352 |
| 2011/0111900 | A1 * | 5/2011 | Wilson | F16C 13/006 474/166 |
| 2014/0237900 | A1 * | 8/2014 | Imaoka | E05F 11/486 49/352 |
| 2015/0101252 | A1 * | 4/2015 | Baba | E05F 11/486 49/349 |
| 2015/0191957 | A1 * | 7/2015 | Takeda | E05F 11/483 49/352 |

FOREIGN PATENT DOCUMENTS

| | | | |
|---|---|---|---|
| JP | 4637522 | B2 | 2/2011 |
| JP | 5134842 | B2 | 1/2013 |

* cited by examiner

GUIDE RAIL FITTING STRUCTURE AND WINDOW REGULATOR

TECHNICAL FIELD

The present invention relates to a guide rail fitting structure in which a guide rail is fitted into a fitting body, and to a window regulator having the guide rail fitting structure.

BACKGROUND ART

A device having a structure in which a guide rail is fitted into a fitting body with an inserted insert is a window regulator having a structure in which a guide rail is fitted into a cable guide with a bolt inserted therein. Window regulators are a widely diffused device for moving up and down automotive window glass (e.g., refer to Patent Literature 1). For example, a window regulator includes a carrier plate for holding a pane of window glass, a guide rail for guiding the ascent and descent of the carrier plate, a cable attached to a top and a bottom of the carrier plate, a cable guide disposed at an end of the guide rail to change the direction of force transmitted from the cable, and a driver to work pull operation on the cable. The window regulator having this configuration moves up and down the window glass.

The cable guide is fitted with a bolt for fastening the window regulator to a door panel of a motor vehicle, for example. An end of the bolt fitted into the cable guide protrudes out of the cable guide. The protruded end of the insert bolt is fastened to a door panel of a motor vehicle, for example.

CITATION LIST

Patent Literature

Patent Literature 1: JP 2004-150060 A

SUMMARY OF INVENTION

Technical Problem

Insert molding is a method of fitting a bolt into a cable guide. However, insert molding is a difficult technique and involves requiring molding accuracy to achieve fixation with a predetermined strength and at a precise location. Insert molding may consist of complicated production processes, such as cutting and processing an insert bolt that is insert-molded in a cable guide to prevent the insert bolt from turning free or coming off If a shaft is attached to a cable guide as disclosed in Patent Literature 1, a pulley and a main body of the cable guide are attached to a guide rail. This configuration requires dimensional accuracy for these components, as well as assembly man-hours because each attachment involves fitting.

It is an object of the present invention to provide a guide rail fitting structure and a window regulator that allow simple assembly.

Solution to Problem

A guide rail fitting structure according to an aspect of the present invention includes: a guide rail; a fitting body; and an insert inserted into the fitting body, the guide rail being fitted into the fitting body, wherein the fitting body comprises: a fitting section fitted onto an end of the guide rail; and an insertion hole into which the insert is inserted from outside the fitting body, and wherein the fitting section is fitted onto the guide rail such that the insert is at least partially covered with the guide rail, the insert gets into a detachment inhibitive state, and the insert in the detachment inhibitive state is visible through an opening on an outer surface of the fitting body.

Advantageous Effects of Invention

A guide rail fitting structure according to the present invention can suppress the number of parts as well as man hours needed for assembly, and permits the fitting of an insert into a cable guide without difficulty while preventing the insert from coming off.

DESCRIPTION OF EMBODIMENTS

An embodiment of the present invention will now be described in detail with reference to the attached drawings.

(Embodiment)

Figure 1:
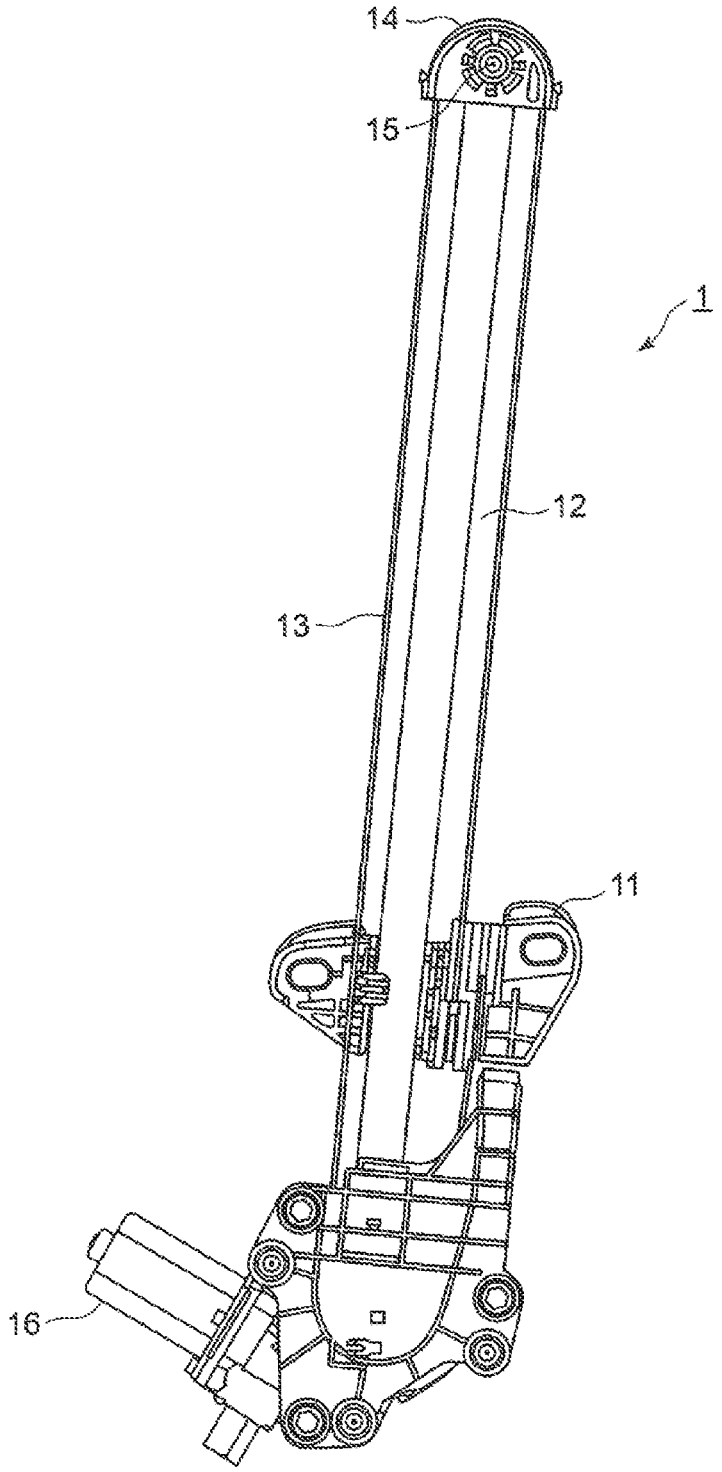
FIG. 1 is an elevation view of a window regulator according to an embodiment of the present invention.

FIG. 1 is an elevation view illustrating the structure of a window regulator 1 according to an embodiment of the present invention. With reference to FIG. 1, the structure of the window regulator 1 will now be described. In the embodiment described hereafter, it is assumed that the window regulator 1 is applied to a motor vehicle and that a direction above and below the window regulator 1 on the motor vehicle is defined as an up and down direction.

Figure 3:
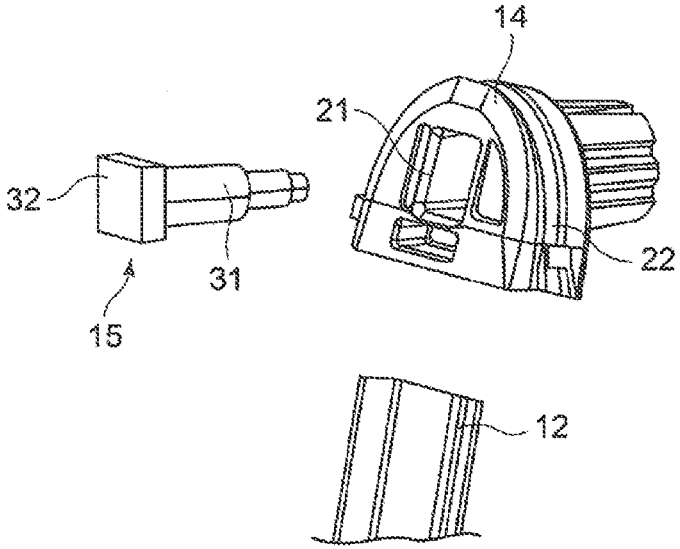
FIG. 3 is an exploded perspective view illustrating the cable guide of FIG. 1.

The window regulator 1 includes a carrier plate 11, a guide rail 12, a cable 13 made up of an ascending cable and a descending cable, a cable guide 14, a mounting bolt 15 (hereafter referred to as a "bolt") as shown in FIG. 3, a motor 16, and a drum (not shown).

The carrier plate 11 is a component that is movable along the guide rail 12 and that is connected to a pane of window glass. The carrier plate 11 is connected to a glass holder mounted on a bottom of the window glass, for example. The window glass is secured via the glass holder. One end of the cable 13 is attached to an upper part of the carrier plate 11, while the other end of the cable 13 is attached to a lower part of the carrier plate 11.

The guide rail 12 guides the ascent and descent of the carrier plate 11. The guide rail 12 is disposed so as to extend in the up and down direction, and has a U-shaped cross section. The guide rail 12 may have an L- or arc-shaped cross section or a cross section of any variation of these shapes, other than the U-shaped cross section.

The cable 13 includes the ascending cable whose one end is attached to the upper part of the carrier plate 11 and the descending cable whose one end is attached to the lower part of the carrier plate 11. The other ends of the ascending and descending cables are attached to the drum. The cable 13 is wound on the drum that is driven to move up and down the carrier plate 11.

The cable guide 14 (equivalent to a fitting body) is provided on an end of the guide rail 12. The cable guide 14 guides the cable 13 and changes a direction in which the cable 13 moves. In other words, the cable guide 14 changes a direction of force transmitted by the cable 13. The bolt 15 is secured to the cable guide 14. Details about the cable guide 14 will be described later.

The bolt 15 (equivalent to an insert) is inserted into an insertion hole 21 of the cable guide 14. The inserted bolt 15 is connected to a door panel of the motor vehicle, for example. This configuration allows the bolt 15 to fasten the window regulator 1 to the door panel. The bolt 15 includes a shank 31, i.e. a section inserted into the insertion hole 21, and a head 32 that is larger in diameter than the shank 31 and connected to an end of the shank 31.

A guide rail fitting structure according to this embodiment includes the guide rail 12, the cable guide 14, and the bolt 15 described above, wherein the guide rail 12 is fitted into the cable guide 14.

The motor 16 that is supplied with electric power rotates the drum (not shown). The motor 16 is equipped with an output shaft to output torque to the drum. The output shaft is directly or indirectly connected to a rotating shaft of the drum. The motor 16 rotates the output shaft in normal or reverse directions.

The cable 13 is wound on the drum. The drum rotates to wind or unwind the cable 13.

Figure 2:
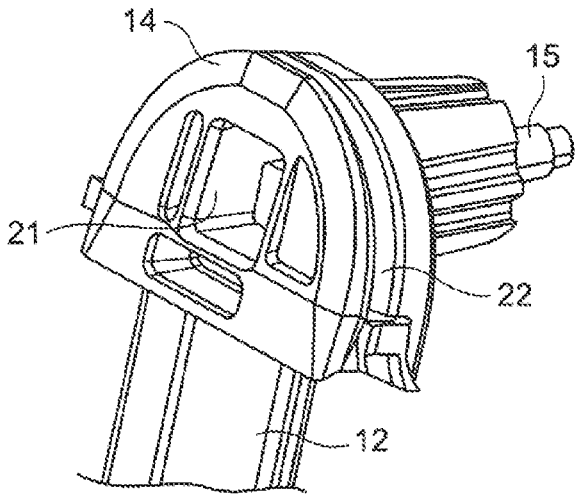
FIG. 2 is an enlarged perspective view illustrating a cable guide that is a part of the window regulator of FIG. 1.
Figure 4:
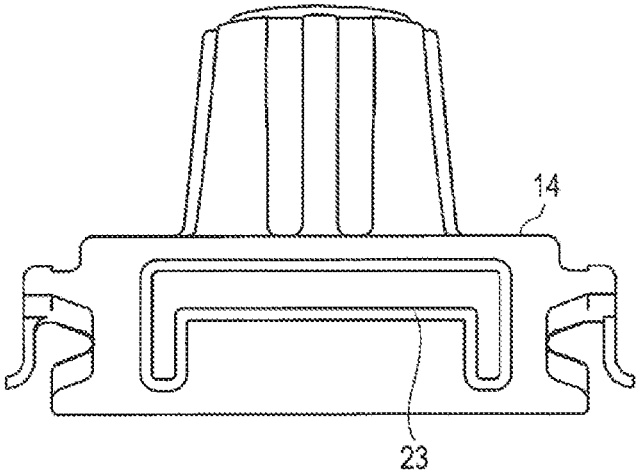
FIG. 4 is a bottom view of the cable guide of FIG. 1.
Figure 5:
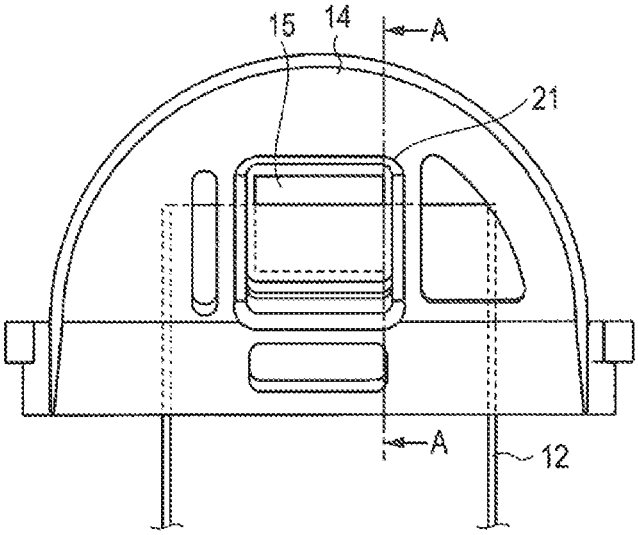
FIG. 5 is an elevation view illustrating a bolt and a guide rail that are fitted into the cable guide of FIG. 1.
Figure 6:
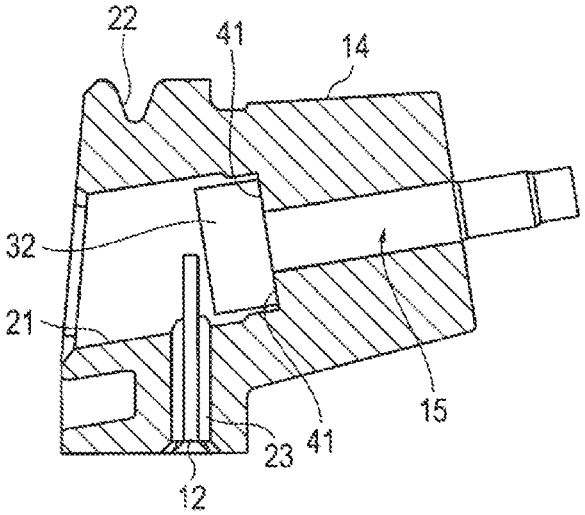
FIG. 6 is a cross-sectional view of the cable guide in FIG. 5, taken from line A-A.

With reference to FIGS. 2 to 5, the above-mentioned cable guide 14 will now be described. FIG. 2 is an enlarged perspective view illustrating the cable guide 14 of FIG. 1. FIG. 3 is an exploded perspective view illustrating the cable guide 14 of FIG. 1. FIG. 4 is a bottom view of the cable guide 14 of FIG. 1. FIG. 5 is an elevation view illustrating the bolt and the guide rail that are fitted into the cable guide 14 of FIG. 1. FIG. 6 is a cross-sectional view of the cable guide in FIG. 5, taken from line A-A.

The cable guide 14 includes the insertion hole 21, a U-shaped groove 22, and a fitting section 23.

The insertion hole 21 permits the bolt 15 to be inserted into with passing through the cable guide 14, and is disposed such that a direction axis extending along the insertion hole 21 and a direction axis extending along the fitting section 23 cross each other. The insertion hole 21 includes a space for allowing the head 32 of the bolt 15 to move and a shaft hole for allowing the shank 31 of the bolt 15 to be inserted through. The space has a fitting seat 41 (refer to FIG. 6) which the head 32 of the inserted bolt 15 comes into contact with and fits onto.

The U-shaped groove 22 is made in the form of a semicircular arc around an outer periphery (excluding a bottom face) of the cable guide 14. The cable 13 is arranged along the U-shaped groove 22. The cable 13 slides along the U-shaped groove 22.

The fitting section 23 is formed at a lower part of the cable guide 14 and constitutes a hole which the end of the guide rail 12 is fitted into. The fitting section 23 is disposed so as to communicate with the space of the insertion hole 21 where the head 32 of the bolt 15 moves. After the bolt 15 is inserted into the insertion hole 21, fitting of the guide rail 12 into the fitting section 23 takes place.

In FIGS. 2 and 3, the head 32 of the bolt 15 and the insertion hole 21 have the form of a quadrangular prism and thereby prevent the bolt 15 from turning free. The head of the bolt may have the form of a hexagonal or any polygonal prism, other than the quadrangular prism, provided that the head can fit on the fitting seat 41 and is larger in diameter than the shank.

The cable guide 14 that is mounted on the guide rail 12 is short in size in the lengthwise direction of the guide rail 12 to allow the carrier plate 11 to move in a wide range. The cable guide 14 is substantially semicircular in form. As a result, the insertion hole 21 and the fitting section 23 are disposed at locations such that the strength of the U-shaped groove 22 is capable of being ensured. According to the present invention, the cable 13 is arranged along the cable guide 14 and presses the cable guide 14 against the guide rail 12 so as to prevent the cable guide 14 from coming off the guide rail 12.

With reference to FIG. 5, the fitting section 22 of the cable guide 14 is fitted on the guide rail 12, it follows that the end of the guide rail 12 gets into the insertion hole 21 of the cable guide 14, and the guide rail 12 and the insertion hole 21 intersect with each other. At this time, the head 32 of the bolt 15 is at least partially covered with the guide rail 12 and put between the fitting seat 41 and the guide rail 12 and the end of the guide rail 12 is brought into contact with the head 32 of the bolt 15. This configuration restrains the movement of the bolt 15 and creates a state in which detachment of the bolt 15 from the cable guide 14 is prevented (a detachment inhibitive state). Consequently, the number of parts and man hours needed for assembly can be suppressed. The head 32 of the bolt 15 is partially visible through an opening of the insertion hole 21. In other words, the disposition of the bolt 15 is visible, and the bolt 15 in the detachment inhibitive state is visible. This configuration enables checking of insertion of the bolt 15 into the insertion hole 21 and fitting of the guide rail 12 into the cable guide 14 at once.

In the guide rail fitting structure according to this embodiment described above, fitting the fitting section 22 of the cable guide 14 onto the guide rail 12 means that the head 32 of the bolt 15 inserted into the insertion hole 21 of the cable guide 14 is at least partially covered with the guide rail 12, and thus the bolt 15 gets into the detachment inhibitive state. As a result, simple assembly involving just inserting the bolt 15 into the cable guide 14 and fitting the guide rail 14 into the cable guide 14 without insert molding enables the bolt 15 to reach the detachment inhibitive state. This configuration can suppress the number of parts as well as man hours needed for assembly, and permits the fitting of the bolt 15 into the cable guide 14 at low costs without difficulty while preventing the bolt 15 from coming off.

In the embodiment described above, the cable guide acts as a fitting body. The scope of the present invention is not limited to this example. A support which a rotating shaft of a pulley is fitted into may act as a fitting body. In this case, the rotating shaft of the pulley may not protrude from the support.

In the embodiment described above, the bolt is taken as an example insert that is inserted into the cable guide. The scope of the present invention is not limited to this example. The insert according to the present invention may be any fastening hardware or a shaft-shaped component, for example. Examples of the fastening hardware include bolts, screws, and other fasteners that are used to fix a guide rail fitting structure composed of a guide rail and a fitting body to a body of a motor vehicle or any other object subject to fixing. The shaft-shaped component may be any shaft-shaped member such as a rotating shaft of a pulley that is supported by a support if the support replaces the cable guide.

In the embodiment described above, the cable guide is fitted on the guide rail such that the guide rail gets into the insertion hole of the cable guide. The scope of the present invention is not limited to this example. The guide rail may directly or indirectly push another component such that the component gets into the insertion hole, provided that the component at least partially covers the head of the bolt.

In the embodiment described above, the window regulator has an example configuration as shown in FIG. 1. The scope of the present invention is not limited to this example. The window regulator may include a driver to work pull operation on cable, two pulleys, a carrier plate disposed to move between the two pulleys, and a cable that is attached to a top and a bottom of the carrier plate and that is arranged to run over the two pulleys and the driver, for example.

In the embodiment described above, the guide rail is applied to the example window regulator. The scope of the present invention is not limited to this example. The guide rail may be applied to curtain rails, sliding doors and any other apparatus that allows a slidable object to move along a guide rail.

INDUSTRIAL APPLICABILITY

The present invention can be applied to a guide rail fitting structure in which a guide rail is fitted into a fitting body, and to window regulators.

REFERENCE SIGNS LIST

11 carrier plate
12 guide rail
13 cable
14 cable guide
15 bolt
16 motor
21 insertion hole
22 U-shaped groove
23 fitting section
31 shank
32 head
41 fitting seat

The invention claimed is:

1. A guide rail fitting structure comprising:
a guide rail;
a fitting body;
a cable arranged along the fitting body so as to press the fitting body against the guide rail;
a carrier plate moveable along the guide rail; and
an inserted body which is inserted into the fitting body, the guide rail being fitted into the fitting body: the fitting body comprises:
a fitting section fitted onto an end of the guide rail; and
an insertion hole having a first entrance into which the inserted body is inserted from the outside and further having a separate entrance;
by fitting of the fitting section onto the guide rail, an end of the guide rail is received within the separate entrance of the insertion hole and the inserted body is at least partially covered by the guide rail, thereby movement of the inserted body is restrained and detachment of the inserted body from the fitting body is prevented.

2. The guide rail fitting structure according to claim 1,
wherein the fitting body comprises a fitting seat that a head of the inserted insert fits on, and
wherein the guide rail fitted into the fitting section and the insertion hole intersect with each other such that the guide rail partially covers the head fitting on the fitting seat.

3. A window regulator comprising the guide rail fitting structure according to claim 2, wherein
the fitting body guides the cable and changes direction in which the cable moves, and
the inserted body is a mounting bolt.

4. A window regulator comprising the guide rail fitting structure according to claim 1, wherein
the fitting body guides the cable and changes direction in which the cable moves, and
the inserted body is a mounting bolt.

* * * * *